US009510634B2

(12) United States Patent
Bookbinder et al.

(10) Patent No.: US 9,510,634 B2
(45) Date of Patent: Dec. 6, 2016

(54) HAT LANYARD

(71) Applicant: Alphasource, Inc., Philadelphia, PA (US)

(72) Inventors: Andrea Bookbinder, Wynnewood, PA (US); Brian Bookbinder, Wynnewood, PA (US)

(73) Assignee: ALPHASOURCE INC., Philadelphia, PA (US)

( * ) Notice: Subject to any disclaimer, the term of this patent is extended or adjusted under 35 U.S.C. 154(b) by 397 days.

(21) Appl. No.: 14/159,586

(22) Filed: Jan. 21, 2014

(65) Prior Publication Data

US 2014/0201888 A1 Jul. 24, 2014

Related U.S. Application Data

(60) Provisional application No. 61/754,388, filed on Jan. 18, 2013.

(51) Int. Cl.
*A42B 7/00* (2006.01)

(52) U.S. Cl.
CPC ..... *A42B 7/00* (2013.01)

(58) Field of Classification Search
CPC ..... A42B 1/24; A42B 3/04; A42B 3/0473; A42B 7/00
USPC ..... 2/422, 410, 421, 175.1, 175.6, 209.13, 2/411, 338, 336
See application file for complete search history.

(56) References Cited

U.S. PATENT DOCUMENTS 5,675,841 A * 10/1997 Jackson ..... A42B 7/00 2/175.7
6,154,887 A * 12/2000 Yagi ..... A42B 7/00 2/175.6
6,446,265 B1 * 9/2002 Moreau ..... A42B 7/00 2/175.7
6,648,101 B2 * 11/2003 Kurtgis ..... A62B 35/0075 182/145
6,871,360 B1 * 3/2005 Ashline ..... B60R 22/001 2/411
8,117,678 B2 * 2/2012 Moreau ..... A42B 3/04 2/410
D682,489 S * 5/2013 Kalbach ..... D30/152
2004/0055077 A1 * 3/2004 Wright ..... A42B 3/0473 2/421
2004/0068779 A1 * 4/2004 Duffy ..... A42B 3/0473 2/422
2004/0073987 A1 * 4/2004 Jansen ..... A42B 3/0473 2/422
2005/0177928 A1 * 8/2005 Moreau ..... A42B 3/04 2/421
2006/0242074 A1 * 10/2006 Kokkinen ..... G06F 21/10 705/53

(Continued)

*Primary Examiner* — Gloria Hale
(74) *Attorney, Agent, or Firm* — Fox Rothschild LLP

(57) ABSTRACT

The present invention relates to articles, devices, methods, and systems for securing a hat to a wearer. In certain non-limiting embodiments, it includes the use of a hat lanyard including a lower strap having a first end and a second end and a lower strap fastening mechanism that is adapted to releasably fasten the lower strap to a user's article of clothing; an upper strap comprising a first end and a second end with a first and second fastening section that are adapted to releasably attach to form a loop; and a connector strap having a first end a second end that connects the upper strap to the lower strap.

9 Claims, 3 Drawing Sheets

(56) References Cited

U.S. PATENT DOCUMENTS

| | | | | |
|---|---|---|---|---|
| 2007/0163028 | A1* | 7/2007 | Brauner | A42B 7/00 2/175.7 |
| 2008/0066418 | A1* | 3/2008 | Hildreth | E04B 1/24 52/695 |
| 2008/0134416 | A1* | 6/2008 | Moreau | A42B 3/04 2/411 |
| 2009/0199322 | A1* | 8/2009 | Parrish | A42B 1/24 2/209.13 |
| 2010/0213064 | A1* | 8/2010 | Latham | G01N 27/44739 204/456 |
| 2014/0201888 | A1* | 7/2014 | Bookbinder | A42B 7/00 2/338 |

* cited by examiner

HAT LANYARD

CROSS REFERENCE TO RELATED APPLICATIONS

The present application claims the priority benefit of U.S. Provisional Application No. 61/754,388, filed on Jan. 18, 2013, the contents of which are incorporated herein by reference in its entirety.

FIELD OF THE INVENTION

The present invention relates, in part, to lanyards for use in connection with apparel worn for personal protection, particularly, thought not exclusively, with hard hats.

BACKGROUND OF THE INVENTION

Hard hats are a mandatory safety item used in or around many electrical power plants, chemical plants, construction sites, warehouses, and other industrial sites. The requirements are often mandated through safety programs due to overhead hazards associated in these types of industries. Hard hats are intended to be a type of safety equipment that will protect the wearer from overhead hazards as well as from bumping one's head in areas where there are low clearances. There are, however, instances when the hard hat can act as a hazard, in itself. For instance, in most industrial work places where overhead work is being performed, workers are typically wearing a hard hat. If a worker leans over or bumps his or her head, the hard hat can, in many instances, fall off of the head of the wearer. This may cause the hard hat to become falling object and a hazard to personnel or vital plant equipment below.

A chin strap used with a hard hat is one method to keep the hard hat on a wearer's head. This method, however, can be uncomfortable and sometimes a bit cumbersome. Another issue is that the chin strap is in direct contact with exposed skin. When working in contaminated or chemical environments, items that are in direct contact with exposed skin should be laundered prior to donning. However, hard hats, even with chin straps, are not typically laundered. Therefore, if the hard hat is used in a harsh or contaminated environment, it can spread to the wearer's exposed skin.

U.S. Pat. No. 701,639 to Stamm discloses a hat guard device that prevents a straw hat from blowing away. One end of the retainer is hooked through the hat, and the other end is hooked into the lapel button hole. This system may have been acceptable for straw hats, however, it is not readily adaptable for use with hard hats. For example, without modification of existing hard hats, one cannot insert a hook into a hard hat because the hard hat material is too hard by its very nature and drilling a hole through the hat could compromise the integrity of the material. Also, the weight of the hard hat could pull through a lapel button hole, if the hat fell off of the wearer's head.

U.S. Pat. No. 4,991,236 to Pritchett discloses a hat retaining device that attaches at one end to a hat and at the other end around the wearer's neck. Such a design, however, would be undesirable for use with a hard hat because of the danger of attaching a loop around the wearer's neck when working in an industrial environment.

U.S. Pat. No. 6,154,887 to Yagi discloses a hat and retaining device having a permanent stopper affixed to the crown of the hat on one end and a clip on the other. This would also be unsuitable for use with a hard hat because it would require modifying standard safety equipment made to a particular standard. Adding devices to the crown of a hard hat may make it unsafe in an accident or otherwise compromise the integrity of the hard hat material.

SUMMARY OF THE INVENTION

In one aspect, the present invention is directed to a hat lanyard including a lower strap, an upper strap and a connector strap therebetween. The lower strap includes a first end and a second end. A fastening mechanism (such as but not limited to a clip, a hook and loop fastener, a hook, snap, button, and combinations thereof) is coupled to the lower strap second end, wherein the fastening mechanism is adapted to fasten the lower strap second end to a user's article of clothing.

The lanyard upper strap also includes a first end and a second end. A first and second fastening section are coupled to the upper strap and are adapted to releasably attach together to form a loop. In certain non-limiting aspects, the first fastening section is coupled to the upper strap at or about the first end of the upper strap and a second fastening section is coupled to the upper strap at or about its second end such that the loop is for along the length of the upper strap.

The connector strap is provided to couple the upper strap to the lower strap. It includes a first end a second end, where the first end of the connector strap is coupled to the second end of the upper strap and the second end of the connector strap is fastened to the first end of the lower strap. In certain embodiments, the connector strap is manufactured from a flexible or stretchable material, which may allow for flexibility and improved safety with the lanyard.

In certain non-limiting embodiments, each aspect of the lanyard, i.e. each of the components provided herein, are non-conductive and/or non-corrosive.

The foregoing embodiments of the lanyard (or any other embodiment herein) may be used in a method to secure a hat to a wearer by the steps of (a) optionally adjusting a length of the lower strap; (b) securing the upper strap to a portion of a hat by way of its first and second fastening sections; and (c) securing the lower strap to a portion of an article of clothing worn by the wearer. In certain non-limiting embodiments, the hat to be secured to the user is a hard hat.

The present invention is not limited to the foregoing embodiments. Additional embodiments and advantages will be readily apparent to the skilled artisan on the basis of the disclosure provided herein.

DETAILED DESCRIPTION OF THE PREFERRED EMBODIMENT

In certain aspects, the present invention relates to a hat lanyard for securing a hat to a wearer. Particularly, in certain embodiments the present invention relates to a lanyard for securing a hard hat to a wearer. Such an embodiment, however, is not considered limiting to the invention, and the present invention contemplates that the teachings herein are readily adaptable to include any type of hat or headwear or any other type of similar application that would be readily apparent to one of skill in the art.

In certain embodiments, the lanyard includes a lower strap for securing the lanyard to the wearer or, in certain embodiments, to the wearer's clothing and an upper end for securing the lanyard to the hat. The lower strap includes a first end and a second end and an associated fastening mechanism for securing the lower strap second end to the wearer or an article of a wearer's clothing. The upper strap also includes a first end and a second end and all upper strap fastening mechanism for fastening the strop to the hat. In certain embodiments, lanyard also includes an intermediate elastic section coupling the lower strap first end to the upper strap second end and providing for flexibility in the lanyard.

Figure 1:
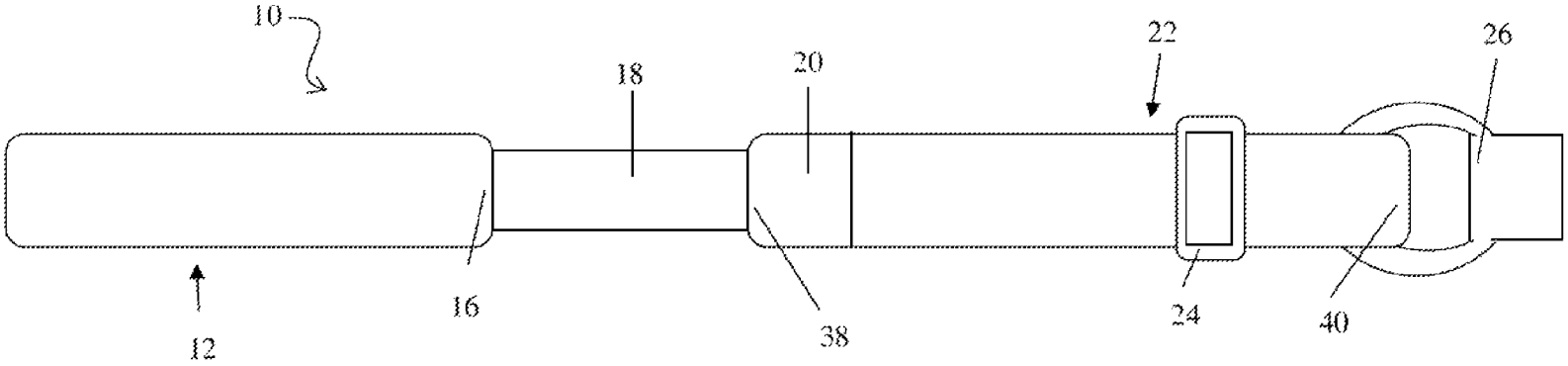
FIG. 1 is a top down plan view of an embodiment of the lanyard of the present invention.

One non-limiting embodiment of the invention is shown in FIGS. 1-4. With reference to FIG. 1, the hat lanyard 10 includes an upper strap 12 and a lower strap 22. The straps are illustrated as a substantially flat material, which may be manufactured from a flexible woven fabric, such as nylon or some other similar polymeric material. One of skill in the art will readily appreciate that the shape of the straps and the materials used to manufacture them is no not necessarily limited to such embodiments. Rather, the lanyard straps may be constructed from any other suitable material and in any other shape otherwise known or readily apparent to the skilled artisan. In certain non-limiting embodiments, the upper and lower straps are made from non-conductive and/or non-corrosive material(s).

The lower strap 22 has a first end 38 and a second end 40. It includes a medial loop 20, which may be positioned at or about the first end 38 (or anywhere along the lower rap a terminal loop 28, which may be positioned at or about the second end 40 of the lower strap. The medial loop 20 forms a single or multiple orifices through the lower strap 22, which may be sized to receive items that the user may wish to secure to the lanyard. By way of non-limiting example, the medial loop 20 may allow the user to place repeatedly used items, such as earplugs, glasses, personal protective equipment (PPE), writing instruments, or the like, at an easily accessible location.

Figure 2:
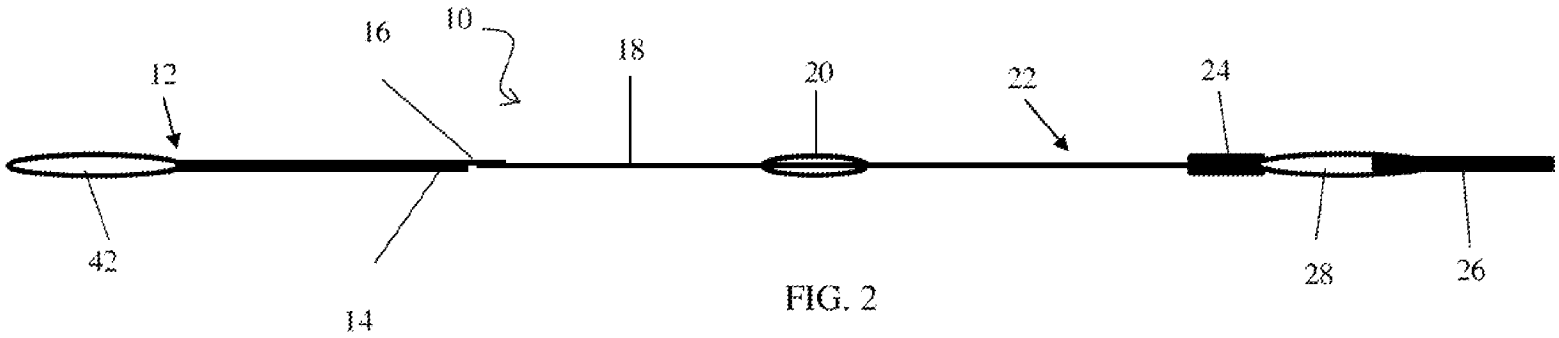
FIG. 2 is a side view of the embodiment of the lanyard shown in FIG. 1.

In certain aspects, and as shown in FIG. 2, a safety clip 26 is attached at the second end of the 40 of the lower strap 22 through use of the terminal loop 28. The clip 26 may be removably attached or otherwise permanently affixed to the lower strap 22 via loop 28. The safety clip 26 is adapted to clip on to an article of clothing of the user so as to secure the lanyard to the user. By way of example, the clip may operate to pinch or otherwise frictionally engage a portion of the wearer's clothing, such as a shirt, jacket, collar, sleeve, or the like. It may lock into place or otherwise include any mechanism for ensuring the retention of the clothing within the clip such that the clip is not easily or inadvertently dislodged from the material. The foregoing embodiment, and that depicted in the FIGS. 1-4, provides only one embodiment of the safety clip. Any suitable alternative fastening mechanism known in the art may be used for the same or similar purposes. Non-limiting examples of such alternatives include a hook and loop fastener, a hook, snap, button, or the like, including combinations thereof. In certain non-limiting embodiments, the clip 26 is made from non-conductive and/or non-corrosive material(s).

In certain embodiments, the length of the lower strap 22 may be adjustable to suit the desires of the user. As depicted in FIGS. 1-4, this adjustability may be performed by providing the lower strap 22 of a sufficient length such that it can be folded through the clip 26 and secured upon itself through the use of a slide buckle 24. The slide buckle 24, and length of the lower strap 22, can then be adjusted by sliding the lower strap 22 through the slide buckle 24, such that the length of the strap becomes longer or shorter. In certain non-limiting embodiments, the slide buckle (or any other portion used to adjust the length of the lower strap) is made from non-conductive and/or non-corrosive material(s). The present invention, however, is not limited to this embodiment and any other suitable means known in the art for allowing adjustability of straps may also be used.

The upper strap 12 has a first end 14 and a second end 16. The second end 16 of the upper strap 12 is connected to the first end 38 of the lower strap 22 by an intermediate connector section 18. The intermediate connector section 18 is preferably formed from a stretchable or elastic fabric or material, such as rubber, an elastomeric polymer, or the like. In certain preferred aspects, the material is not electrically conductive and/or is manufactured from non-corrosive materials. Use of a stretchable material can provide flexibility in the lanyard and can also dampen, or soften, the initial shock of impact of the hat against the wearer or some other surface when it has fallen from the wearer's head. Although a non-stretchable fabric can be used, the trauma to all the components of the hat lanyard, clothing attached to the hat lanyard, and the hat itself would be much greater when the hat falls from the wearer's head. This could accelerate wearing, or even tearing of components of the hat lanyard, as well as the clothing or hat attached to the hat lanyard. Thus, in certain embodiments, it is preferred that the intermediate connector section 18 be made, at least in part, from the flexible or stretchable material.

Figure 3:
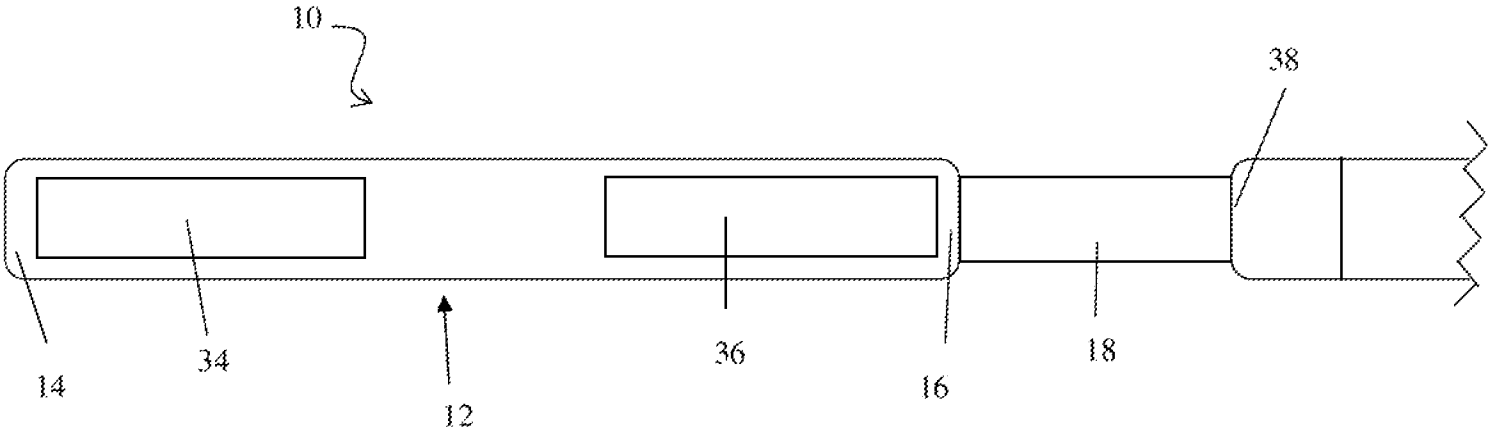
FIG. 3 is a bottom plan view of a portion of the embodiment of the lanyard shown in FIG.
Figure 4:
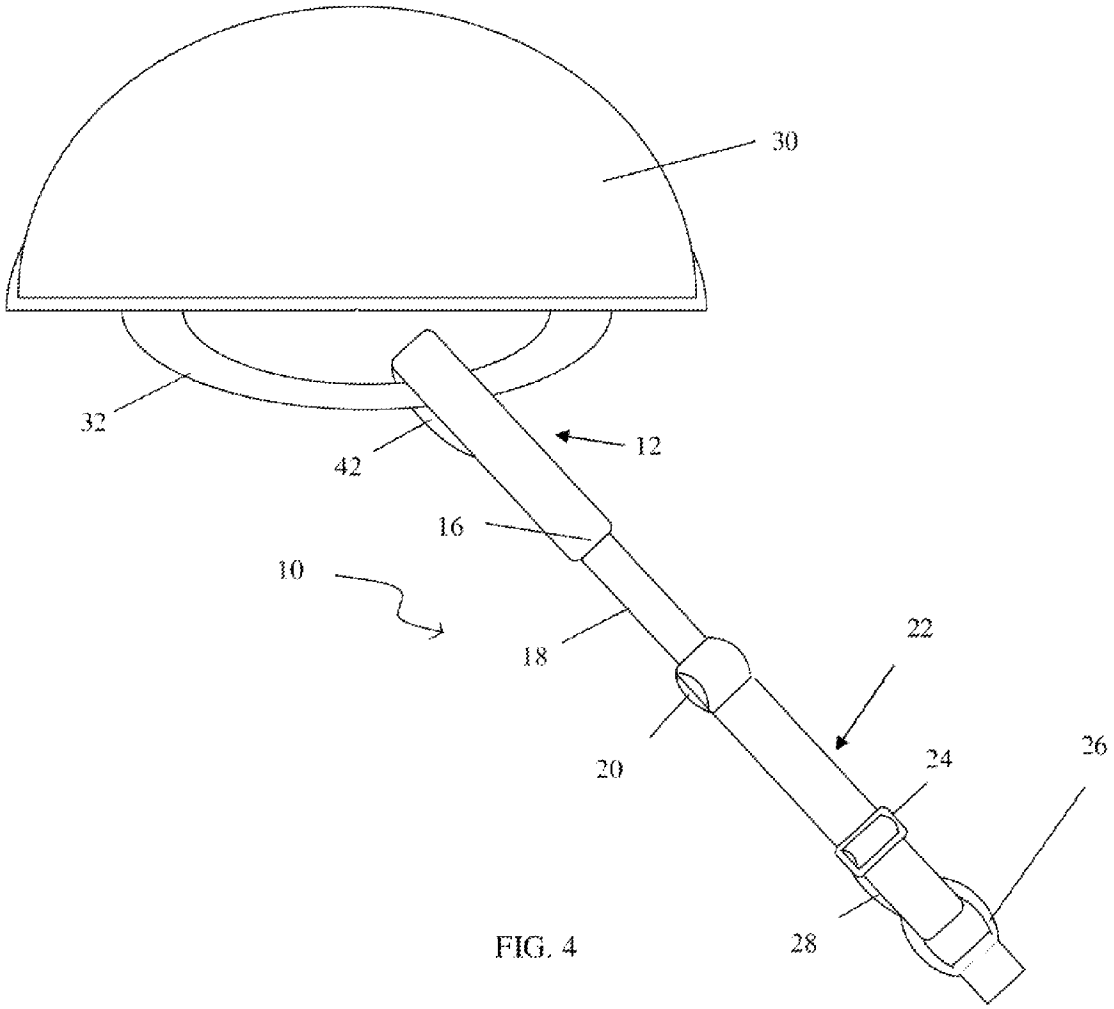
FIG. 4 is a perspective view of the embodiment of the lanyard shown in FIG. 1 attached to a hard hat.

As best shown in FIGS. 3 and 4, the underside of the upper strap 12 includes a first fastening pad 34 located towards the first end 14 and a second fastening pad 36. The second fastening page 36 is illustrated as being at or about the second end 16 of the upper strap 12, however, it is not limited to this position may be provided at any point along the length of the upper strap 12. The first fastening pad 34 and second fastening pad 36 are adapted to removably attach to one another to form a loop 42 out of upper strap 12. For example, the fastening pads 34, 36 comprise a hook-and-loop fastener system, such as VELCRO®. This allows the user to adjust the size of the loop 42 based on the desired distance or for comfort. It should be understood, however, that in carrying out the present invention, the ends 14,16 of the upper strap may be removably attached to each other using other means, such as, but not limited to, adhesives, snaps, buttons, clips, or the like, including combinations thereof. Additional or alternative fastening mechanisms will be readily apparent to one of skill in the art. In certain non-limiting embodiments, the fastening mechanism is made from non-conductive and/or non-corrosive material(s).

Use of the hat lanyard 10 in conjunction with a hard hat 30 is shown in FIG. 4. The underside of the hard hat 30 generally has a permanently attached head support structure (not shown), which includes an inner brim 32. The user of the presently described hat lanyard 10 wraps the upper strap 12 around the inner brim 32 and affixes the first fastening pad 34 to the second fastening pad 36 so as to cause upper strap loop 42 to encircle the inner brim 32. The user then attaches safety clip 26 to an article, or a portion of an article, of the user's clothing. Optionally, prior to or after attaching the safety clip 26, the user may adjust the lower strap 14 to a desirable length by using the buckle 24.

In one aspect, the hat lanyard 10 is attached to a portion of the hat or an opening of the hat that cannot be separated. For instance, in certain embodiments, hat lanyard 10 is connected to a non-separating portion of inner brim 32 or directly to the head support structure. Because hard hats have a relatively large amount of mass in comparison to other headwear such as baseball caps and the like, with hard hats it is preferred that the hat lanyard 10 not be connected to a separable portion of the hard hat, such as an adjustment band. In the unfortunate event that the hard hat falls off of one's heat, the hat lanyard functions to prevent the hard hat 30 from falling away from the user and potentially causing injury to a person below, damage to expensive equipment, contamination to a process, and/or any number of unfortunate side effects caused by the falling hard hat 30. If the hat lanyard 10, however, is connected to a separable portion of hard hat 30, the stress imparted on this separable portion caused by the hat lanyard 10 stopping the fall of the hard hat 30 may, at times, cause the hard hat to separate and detach from the hat lanyard 10, thus defeating the purpose of the hat lanyard 10.

Although the preferred embodiments of the present invention have been described herein, the above description is merely illustrative. Further modification of the invention herein disclosed occur to those skilled in the respective arts and all such modifications are deemed to be within the scope of the invention as defined by the appended claims.

What is claimed is:

1. A non-conductive, non-corrosive hat lanyard comprising:

a lower strap comprising a first end, a second end, and a loop between its first and second ends having one or more orifices;

a lower strap fastening mechanism coupled to the lower strap second end wherein the fastening mechanism is adapted to releasably fasten the lower strap second end to a user's article of clothing;

an upper strap comprising a first end and a second end;

a first and second fastening section coupled to the upper strap, wherein the first fastening section is adapted to releasably attach to the second fastening section to form at least a part of the upper strap into a loop; and a connector strap having a first end a second end, wherein the first end of the connector strap is fastened to the second end of the upper strap and the second end of the connector strap is fastened to the first end of the lower strap.

2. The hat lanyard of claim 1, wherein a length of the lower strap is adjustable.

3. The hat lanyard of claim 1, wherein the fastening mechanism of the lower strap is selected from the group consisting of a clip, a hook and loop fastener, a hook, snap, button, and combinations thereof.

4. The hat lanyard of claim 1, wherein the first fastening section is coupled to the upper strap at or about its first end and a second fastening section is coupled to the upper strap at or about its second end.

5. The hat lanyard of claim 1, wherein the one of the first fastening section or second fastening section of the upper strap is receivable by the other of the first fastening section or second fastening section of the upper strap.

6. The hat lanyard of claim 1, wherein the first fastening section and the second fastening section form a hook-and-loop fastener system.

7. The hat lanyard of claim 1, wherein the connector strap is comprised of a stretchable or elastic material.

8. A method for securing a hat to a wearer comprising:

providing a non-conductive, non-corrosive hat lanyard comprising a lower strap having a first end, a second end, and a loop between its first and second ends having one or more orifices; a lower strap fastening mechanism fastened to the lower strap second end wherein the fastening mechanism is adapted to releasably fasten the lower strap second end to a user's article of clothing; an upper strap comprising a first end and a second end; a first and second fastening section coupled to the upper strap and adapted to releasably attach to each other and form loop; and a connector strap having a first end a second end, wherein the first end of the connector strap is fastened to the second end of the upper strap and the second end of the connector strap is fastened to the first end of the lower strap;

optionally adjusting a length of the lower strap;

securing the upper strap to a portion of a hat by way of the first and second fastening sections; and securing the lower strap to a portion of an article of clothing worn by the wearer.

9. The method of claim 8, wherein the hat is a hard hat.

* * * * *